US011866657B1

(12) United States Patent
Koseoglu

(10) Patent No.: US 11,866,657 B1
(45) Date of Patent: Jan. 9, 2024

(54) TWO-STAGE HYDROTREATING OF HYDROCARBONS

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/051,119

(22) Filed: Oct. 31, 2022

(51) Int. Cl.
*C10G 65/04* (2006.01)

(52) U.S. Cl.
CPC ..... *C10G 65/04* (2013.01); *C10G 2300/202* (2013.01); *C10G 2300/4006* (2013.01); *C10G 2300/4012* (2013.01); *C10G 2300/4018* (2013.01)

(58) Field of Classification Search
CPC ..... C10G 65/04; C10G 2300/202; C10G 2300/4006; C10G 2300/4012; C10G 2300/4018
See application file for complete search history.

(56) References Cited

U.S. PATENT DOCUMENTS 5,110,444 A * 5/1992 Haun ..... C10G 65/08 208/143
9,144,752 B2 9/2015 Koseoglu

FOREIGN PATENT DOCUMENTS

EP 0940464 A2 * 1/1999
WO 02074882 A1 9/2002

OTHER PUBLICATIONS

Haider et al., "Two-stage catalytic hydrotreatment of highly nitrogenous biocrude from continuous hydrothermal liquefaction: A rational design of the stabilization stage", Biomass and Bioenergy, vol. 139, 2020, 37 pages.
Song, "An overview of new approaches to deep desulfurization for ultra-clean gasoline, diesel fuel and jet fuel", Catalysis Today, vol. 86, pp. 211-263, 2003.

* cited by examiner

*Primary Examiner* — Ellen M McAvoy
*Assistant Examiner* — Chantel Graham
(74) *Attorney, Agent, or Firm* — DINSMORE & SHOHL

(57) ABSTRACT

A method of processing a hydrocarbon feedstock may comprise hydrotreating the hydrocarbon feedstock in a low-severity hydrotreater to produce a first effluent and hydrotreating the first effluent, or a portion thereof, in a high-severity hydrotreater to produce a low contaminant product. The low-severity hydrotreater may operate at a catalyst volume of less than 60% of a catalyst volume of the high-severity hydrotreater. The low-severity hydrotreater may operate at a hydrogen partial pressure of at least 5 bar lower than the hydrogen partial pressure in the high-severity hydrotreater. The low-severity hydrotreater may operate at a weighted average bed temperature (WABT) of at least 5° C. less than the WABT of the high-severity hydrotreater.

20 Claims, 1 Drawing Sheet

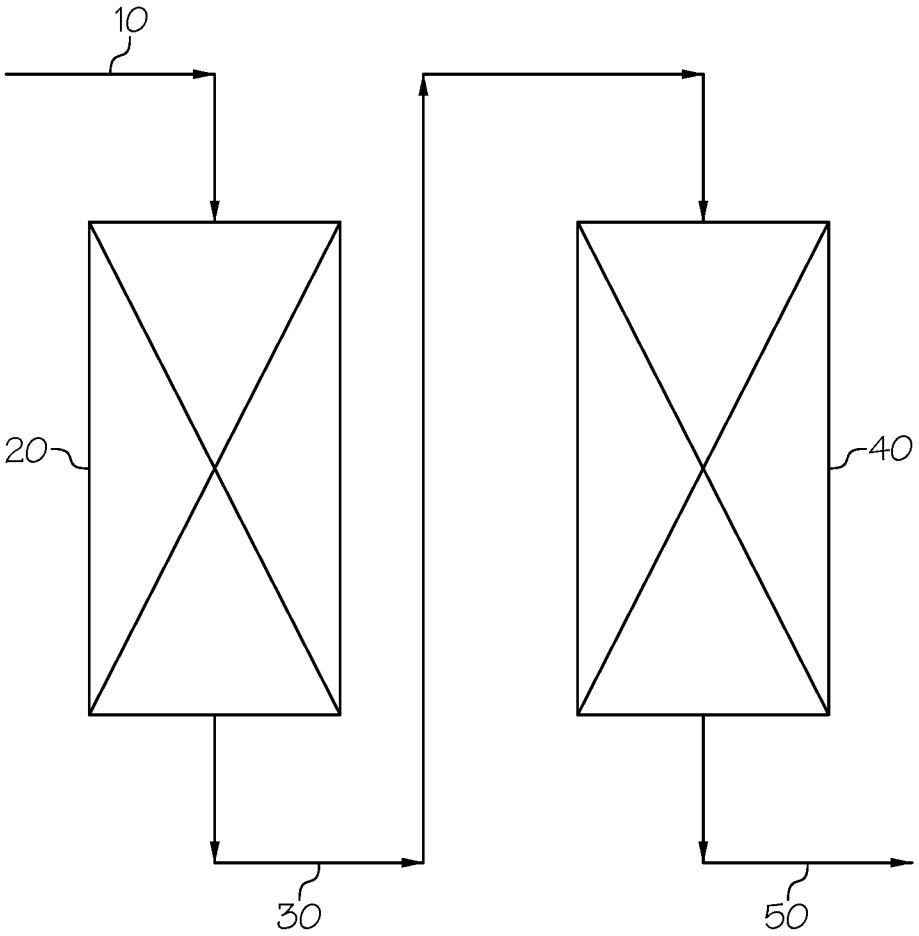
10
20
30
40
50

TWO-STAGE HYDROTREATING OF HYDROCARBONS

BACKGROUND

Field

The present disclosure relates to processes for processing petroleum-based materials and, in particular, processes for hydrotreating hydrocarbon feeds to reduce contaminants.

Technical Background

The discharge into the atmosphere of sulfur compounds during processing and end-use of the petroleum products derived from sulfur-containing crude oil, such as sour crude oil, poses health and environmental problems. Stringent reduced-sulfur specifications applicable to transportation and other fuel products have impacted the refining industry, and it is necessary for refiners to make capital investments to dramatically reduce the sulfur content in gas oils. In industrialized nations such as the United States, Japan and the countries of the European Union, refineries have already been required to produce environmentally clean transportation fuels. For instance, in 2007 the United States Environmental Protection Agency required the sulfur content of highway diesel fuel to be reduced 97%, from 500 ppmw (low sulfur diesel) to 15 ppmw (ultra-low sulfur diesel). The European Union has enacted even more stringent standards, requiring diesel and gasoline fuels sold in 2009 to contain less than 10 ppmw of sulfur. Other countries are following in the footsteps of the U.S. and the European Union and are moving forward with regulations that will require refineries to produce transportation fuels with ultra-low sulfur levels.

To meet these ultra-low sulfur requirements, refiners must choose among the various processes and crude oils which provide sufficient flexibility to meet future specifications with minimum additional capital investment. Ideally these future specifications can be met using existing equipment. Conventional technologies such as hydrocracking and two-stage hydrotreating offer solutions to refiners for the production of clean transportation fuels. These technologies are available and can be applied as new production facilities are constructed. However, many existing hydroprocessing facilities, such as those using relatively low pressure hydrotreaters, represent a substantial prior investment and were constructed before these more stringent sulfur reduction requirements were enacted. It is difficult to upgrade existing hydrotreating reactors in these facilities to meet the new and more severe operational requirements (i.e., higher temperature and pressure). Available retrofitting options for refiners include elevation of the hydrogen partial pressure by increasing the recycle gas quality, utilisation of more active catalyst compositions, installation of improved reactor components to enhance liquid-solid contact, increasing reactor volume, and increasing feedstock quality.

There are many hydrotreating units installed worldwide producing transportation fuels containing 500-3000 ppmw sulfur. These units were designed for, and are being operated at, relatively mild conditions (i.e., low hydrogen partial pressures of 30 bar for straight run gas oils boiling in the range of 180° C. to 370° C.).

With the increasing prevalence of more stringent environmental sulfur specifications in transportation fuels mentioned above, the sulfur levels must often be reduced to less than 10 ppmw or 15 ppmw. This ultra-low level of sulfur typically requires either construction of new high pressure hydrotreating units or a substantial retrofitting of existing facilities. For example it may require incorporating gas purification systems, reengineering the internal configuration and components of reactors, and/or deployment of more active catalyst compositions.

Sulfur-containing compounds that are typically present in hydrocarbon fuels include aliphatic molecules such as sulfides, disulfides and mercaptans as well as aromatic molecules such as thiophene, benzothiophene and its long chain alkylated derivatives, and dibenzothiophene and its alkyl derivatives such as 4,6-dimethyl-dibenzothiophene.

Aliphatic sulfur-containing compounds are more easily desulfurized (labile) using mild hydrodesulfurization methods. However, certain highly branched aromatic molecules can sterically hinder the sulfur atom removal and are more difficult to desulfurize (refractory) using mild hydrodesulfurization methods.

Among the sulfur-containing aromatic compounds, thiophenes and benzothiophenes are relatively easy to hydrodesulfurize. The addition of alkyl groups to the ring compounds increases the difficulty of hydrodesulfurization. Dibenzothiophenes resulting from addition of another ring to the benzothiophene family are even more difficult to desulfurize, and the difficulty varies greatly according to their alkyl substitution, with di-beta substitution being the most difficult to desulfurize, thus justifying their "refractory" appellation. These beta substituents hinder exposure of the heteroatom to the active site on the catalyst.

When previous regulations permitted sulfur levels up to 500 ppmw, there was little need or incentive to desulfurize beyond the capabilities of conventional hydrodesulfurization, and hence the refractory sulfur-containing compounds were not targeted. However, in order to meet the more stringent sulfur specifications, these refractory sulfur-containing compounds must be substantially removed from hydrocarbon fuels streams. Accordingly removal of sufficient sulfur-containing compounds from hydrocarbon fuels to achieve an ultra-low sulfur level is very costly.

SUMMARY

Accordingly, there is an ongoing need for processes, which can be retrofitted to existing refineries which will allow them to meet the ultra-low sulfur levels required. The processes of the present disclosure meet this need by providing a two stage hydrotreating system, where the first stage operates at relatively less severe conditions and the second stage operates at relatively more severe conditions.

According to at least one embodiment of the present disclosure, a method of processing a hydrocarbon feedstock may comprise hydrotreating the hydrocarbon feedstock in a low-severity hydrotreater to produce a first effluent and hydrotreating the first effluent, or a portion thereof, in a high-severity hydrotreater to produce a low contaminant product. The low-severity hydrotreater may operate at a catalyst volume of less than 60% of a catalyst volume of the high-severity hydrotreater. The low-severity hydrotreater may operate at a hydrogen partial pressure of at least 5 bar lower than the hydrogen partial pressure in the high-severity hydrotreater. The low-severity hydrotreater may operate at a weighted average bed temperature (WABT) of at least 5° C. less than the WABT of the high-severity hydrotreater.

Additional features and advantages of the embodiments of the present disclosure will be set forth in the detailed description that follows and, in part, will be readily apparent to a person of ordinary skill in the art from the detailed description or recognized by practicing the embodiments of the present disclosure.

BRIEF DESCRIPTION OF THE DRAWING

The following detailed description of the present disclosure may be better understood when read in conjunction with the following drawing in which:

FIG. 1 schematically depicts a generalized flow diagram of a system for hydrotreating a hydrocarbon, according to one or more embodiments of the present disclosure.

When describing the simplified schematic illustration of FIG. 1, the numerous valves, temperature sensors, electronic controllers, and the like, which may be used and are well known to a person of ordinary skill in the art, are not included. Further, accompanying components that are often included in systems such as those depicted in FIG. 1, such as air supplies, heat exchangers, surge tanks, and the like are also not included. However, a person of ordinary skill in the art understands that these components are within the scope of the present disclosure.

Additionally, the arrows in the simplified schematic illustration of FIG. 1 refer to process streams. However, the arrows may equivalently refer to transfer lines, which may transfer process steams between two or more system components. Arrows that connect to one or more system components signify inlets or outlets in the given system components and arrows that connect to only one system component signify a system outlet stream that exits the depicted system or a system inlet stream that enters the depicted system. The arrow direction generally corresponds with the major direction of movement of the process stream or the process stream contained within the physical transfer line signified by the arrow.

The arrows in the simplified schematic illustration of FIG. 1 may also refer to process steps of transporting a process stream from one system component to another system component. For example, an arrow from a first system component pointing to a second system component may signify "passing" a process stream from the first system component to the second system component, which may comprise the process stream "exiting" or being "removed" from the first system component and "introducing" the process stream to the second system component.

Reference will now be made in greater detail to various aspects, some of which are illustrated in the accompanying drawings.

DETAILED DESCRIPTION

Definitions

As used in the present disclosure, the term "API" refers to the American Petroleum Institute.

As used in the present disclosure, the term "cracking" refers to a chemical reaction where a molecule having carbon-carbon bonds is broken into more than one molecule by the breaking of one or more of the carbon-carbon bonds; where a compound including a cyclic moiety, such as an aromatic, is converted to a compound that does not include a cyclic moiety; or where a molecule having carbon-carbon double bonds are reduced to carbon-carbon single bonds. As used in the present disclosure, the term "catalytic cracking" refers to cracking conducted in the presence of a catalyst. Some catalysts may have multiple forms of catalytic activity, and calling a catalyst by one particular function does not render that catalyst incapable of being catalytically active for other functionality.

As used in the present disclosure, the term "catalyst" refers to any substance that increases the rate of a specific chemical reaction, such as cracking reactions.

As used in the present disclosure, the term "crude oil" refers to a mixture of petroleum liquids and gases, including impurities, such as sulfur-containing compounds, nitrogen-containing compounds, and metal compounds, extracted directly from a subterranean formation or received from a desalting unit without having any fractions, such as naphtha, separated by distillation.

As used in the present disclosure, the term "directly" refers to the passing of materials, such as an effluent, from a first component of the system to a second component of the system without passing the materials through any intervening components or systems operable to change the composition of the materials. Similarly, the term "directly" also refers to the introducing of materials, such as a feed, to a component of the system without passing the materials through any preliminary components operable to change the composition of the materials. Intervening or preliminary components or systems operable to change the composition of the materials can include hydrotreaters and separators, but are not generally intended to include heat exchangers, valves, pumps, sensors, or other ancillary components required for operation of a chemical process. Further, combining two streams together upstream of the second component instead of passing each stream to the second component separately is also not considered to be an intervening or preliminary component operable to change the composition of the materials.

As used in the present disclosure, the terms "downstream" and "upstream" refer to the positioning of components or systems relative to a direction of flow of materials through the system. For example, a second component may be considered "downstream" of a first component if materials flowing through the system encounter the first component before encountering the second component. Likewise, the first component may be considered "upstream" of the second component if the materials flowing through the system encounter the first component before encountering the second component.

As used in the present disclosure, the term "effluent" refers to a stream that is passed out of a hydrotreater, a reaction zone, or a separator following a particular reaction or separation. Generally, an effluent has a different composition than the stream that entered the hydrotreater, reaction zone, or separator. It should be understood that when an effluent is passed to another component or system, only a portion of that effluent may be passed. For example, a slipstream may carry some of the effluent away, meaning that only a portion of the effluent may enter the downstream component or system. The terms "reaction effluent" and "hydrotreater effluent" particularly refer to a stream that is passed out of a hydrotreater or reaction zone.

As used in the present disclosure, the term "LHSV" means liquid hourly space velocity. The LHSV is calculated as the volumetric flowrate of feedstock divided by the volume of catalyst. The units of LHSV are $h^{-1}$.

As used in the present disclosure, the term "WABT" means weighted average bed temperature. WABT may be calculated according to the equation $WABT=\Sigma_{i-1}^{N} WABT_i*Wc_i$, where $WABT_i$ is the WABT for a particular section of catalyst bed, N is the number of catalyst beds, and $Wc_i$ is the ith bed's weight fraction of the total bed weight.

As used in the present disclosure, the term "hydrotreater" refers to any vessel, container, conduit, or the like, in which a chemical reaction, such as catalytic cracking, occurs between one or more reactants optionally in the presence of one or more catalysts. A hydrotreater can include one or a plurality of "reaction zones" disposed within the hydrotreater. The term "reaction zone" refers to a region in a hydrotreater where a particular reaction takes place.

As used in the present disclosure, the term "precious metals" refers to platinum, palladium, ruthenium, rhodium, osmium, and iridium.

As used in the present disclosure, the terms "separation unit" and "separator" refer to any separation device(s) that at least partially separates one or more chemical constituents in a mixture from one another. For example, a separation system selectively separates different chemical constituents from one another, forming one or more chemical fractions. Examples of separation systems include, without limitation, distillation columns, fractionators, flash drums, knock-out drums, knock-out pots, centrifuges, filtration devices, traps, scrubbers, expansion devices, membranes, solvent extraction devices, high-pressure separators, low-pressure separators, or combinations of these. The separation processes described in the present disclosure may not completely separate all of one chemical constituent from all of another chemical constituent. Instead, the separation processes described in the present disclosure "at least partially" separate different chemical constituents from one another and, even if not explicitly stated, separation can include only partial separation.

EMBODIMENTS

The present disclosure is directed to methods of desulfurizing a hydrocarbon feed. Among other features, the methods include subjecting the hydrocarbon feed to a first hydrotreating process under low-severity conditions and to a second hydrotreating process under high-severity conditions. Without being limited by theory, it is believed that it may be more efficient to hydrotreat the hydrocarbon feed at low severity first, thereby removing the easily removable aliphatic sulfur compounds. It is believed that high-severity conditions may then be required to remove the more refractory aromatic compounds.

Referring now to FIG. 1, a method 100 of processing a hydrocarbon feedstock 10 may comprise hydrotreating the hydrocarbon feedstock 10 in a low-severity hydrotreater 20 to produce a first effluent 30 and hydrotreating the first effluent 30, or a portion thereof, in a high-severity hydrotreater 40 to produce a low contaminant product 50.

The hydrocarbon feedstock 10 may comprise a whole crude or a fraction of a whole crude. The hydrocarbon feedstock 10 may boil in the range from 36° C. to 565° C., such as from 36° C. to 370° C., from 180° C. to 540° C., from 180° C. to 370° C., or any subset thereof. When the hydrocarbon feedstock 10 boils within a given range, at least 70 wt. %, at least 80 wt. %, at least 90 wt. %, at least 99 wt. %, or even at least 99.9 wt. % of the hydrocarbons in the stream may boil at temperatures within the range.

The hydrocarbon feedstock 10 may have a relatively high concentration of sulfur. It is believed that the methods of the present disclosure may be particularly advantageous when used with sour (high sulfur) crude oils. In some embodiments, the hydrocarbon feedstock 10 has greater than 500 ppm, greater than 750 ppm, greater than 1000 ppm, or greater than 1250 ppm of sulfur, greater than 5000 ppm of sulfur, greater than 10,000 ppm of sulfur, or even greater than 20,000 ppm of sulfur. The hydrocarbon feedstock 10 may have less than 30,000 ppm, less than 20,000 ppm, less than 10,000 ppm, less than 5000 ppm of sulfur, such as less than 4000 ppm, less than 3000 ppm, or less than 2000 ppm of sulfur. The hydrocarbon feedstock may have from 500 ppm to 3000 ppm of sulfur.

The hydrocarbon feedstock 10 may have a relatively low concentration of oxygen containing compounds. For example, the hydrocarbon feedstock 10 may comprise less than 25 wt. %, less than 15 wt. %, less than 10 wt. %, less than 5 wt. %, less than 1 wt. %, less than 0.1 wt. %, less than 0.01 wt. %, less than 0.001 wt. %, or even less than 0.0001 wt. % of oxygen.

The hydrocarbon feedstock 10 may have a relatively low concentration of nitrogen containing compounds. For example, the hydrocarbon feedstock 10 may comprise less than 1 wt. %, less than 0.7 wt. %, less than 0.5 wt. %, less than 0.3 wt. %, less than 0.2 wt. %, less than 0.1 wt. %, less than 0.01 wt. %, less than 0.001 wt. %, or even less than 0.0001 wt. % of nitrogen.

Hydrotreating the hydrocarbon feedstock 10 in the low-severity hydrotreater 20 may comprise exposing the hydrocarbon feedstock 10 to a low-severity hydrotreating catalyst in the presence of hydrogen gas.

The low-severity hydrotreating catalyst may comprise supported metal catalysts. The metals may comprise transition metals, such as one or more of Ni, Mo, Co, and W. The support material may comprise silica, alumina, or silica-alumina. The silica, alumina, or silica-alumina of the support material may be amorphous, crystalline, or a combination thereof. For example, the low-severity hydrotreating catalyst may comprise at least 50 wt. %, at least 75 wt. %, at least 85 wt. %, at least 90 wt. %, at least 95 wt. %, or at least 99 wt. % of Ni, Mo, Co, W, support material. In some exemplary embodiments, the low-severity hydrotreating catalyst may comprise Co, Mo, and Ni, supported on alumina. For example, the low-severity hydrotreating catalyst may comprise from 0.5 wt. % to 10 wt. % Ni and from 5 wt. % to 40 wt. % of Mo, on a total weight of active materials and support materials basis.

The low-severity hydrotreating catalyst may comprise less than 1 wt. % of precious metals. For example, the low-severity hydrotreating catalyst may comprise less than less than 0.5 wt. %, less than 0.1 wt. %, or even less than 0.01 wt. % of precious metals.

The liquid hourly space velocity ("LHSV") may be defined as the volumetric flowrate of hydrocarbon feed divided by the volume of catalyst. The low-severity hydrotreater 20 may operate at a LHSV of from 5 $h^{-1}$ to 15 $h^{-1}$, such as from 5 $h^{-1}$ to 12 $h^{-1}$, or from 8 $h^{-1}$ to 12 $h^{-1}$.

The LHSV of the low-severity hydrotreater 20 may be defined in contrast to the LHSV of the high-severity hydrotreater 40. The LHSV of the low-severity hydrotreater 20 may be 2×, 5×, 7×, or even 10× the LHSV of the high-severity hydrotreater.

The low-severity hydrotreater 20 may operate at a catalyst volume of less than 80% of a catalyst volume of the high-severity hydrotreater 40. For example, the low-severity hydrotreater 20 may operate at a catalyst volume of less than 70%, less than 60%, less than 50%, less than 40%, less than 30%, less than 20%, or even less than 10% of the catalyst volume of the high-severity hydrotreater 40.

The low-severity hydrotreater 20 may operate by contacting the hydrocarbon feed with the low-severity hydrotreating catalyst at a hydrogen partial pressure. For example, the low-severity hydrotreater 20 may operate at a hydrogen partial pressure of less than 50 bar, less than 40 bar, less than 30 bar, less than 20 bar, from 1 to 50 bar, at least 1 bar, at least 5 bar, at least 10 bar, from 1 to 25 bar, from 5 to 50 bar, 5 to 40 bar, from 5 to 30 bar, from 5 to 20 bar, from 10 to 50 bar, from 10 to 40 bar, from 10 to 30 bar, from 10 to 25 bar, from 10 to 20 bar, or any subset thereof.

The low-severity hydrotreater 20 may operate at a hydrogen partial pressure of at least 5 bar lower than the high-severity hydrotreater 40. For example, the low-severity hydrotreater 20 may operate at a hydrogen partial pressure of at least 10 bar, at least 20 bar, at least 25 bar, at least 30 bar, or even at least 35 bar lower than the hydrogen partial pressure in the high-severity hydrotreater 40.

The low-severity hydrotreater 20 may operate at a hydrogen partial pressure of less than 75% of the hydrogen partial pressure of the high-severity hydrotreater 40. For example, the low-severity hydrotreater 20 may operate at a hydrogen partial pressure of less than 60%, less than 50%, less than 40%, or even less than 30% of the hydrogen partial pressure in the high-severity hydrotreater 40, based on the gauge pressure within the reactors.

The low-severity hydrotreater 20 may operate at a WABT less than that of the high-severity hydrotreater 40. The low-severity hydrotreater 20 may operate at a WABT of at least 5° C. less than the WABT of the high-severity hydrotreater 40. For example, the low-severity hydrotreater 20 may operate at a WABT of at least 10° C., at least 15° C., at least 20° C., at least 30° C., or at least 40° C. less than the WABT of the high-severity hydrotreater 40.

The low-severity hydrotreater 20 may operate at a WABT of less than 450° C., less than 375° C., less than 350° C., from 300 to 350° C., from 325 to 350° C., from 340 to 350° C., or any subset thereof.

The first effluent 30 may have less than 70% of the sulfur content of the hydrocarbon feedstock 10. For example, the first effluent 30 may have less than 60%, from 40 to 70%, from 50 to 70%, from 50 to 60% of the sulfur content of the hydrocarbon feedstock 10.

The first effluent 30 may be fed directly from the low-severity hydrotreater 20 to the high-severity hydrotreater 40. For example, the first effluent 30 may not have been subjected to any distillation, fractionation, or combining with other feeds, before being fed to the high-severity hydrotreater 40.

At least 90 wt. % of the first effluent 30 from the low-severity hydrotreater 20 may be fed to the high-severity hydrotreater 40 and at least 90 wt. % of the feed to the high-severity hydrotreater 40 may comprise the first effluent 30. For example, at least 95 wt. %, at least 99 wt. %, or at least 99.9 wt. % of the hydrocarbons in the first effluent 30 may be fed from the low-severity hydrotreater 20 to the high-severity hydrotreater 40. At least 95 wt. %, at least 99 wt. %, or at least 99.9 wt. % of the feed to the high-severity hydrotreater 40 may comprise the first effluent 30.

According to some embodiments, at least some hydrogen sulfide may be removed from the first effluent 30 between the low-severity hydrotreater 20 and the high-severity hydrotreater 40. For example, at least 10 wt. %, at least 20 wt. %, at least 30 wt. %, at least 40 wt. %, at least 50 wt. %, at least 60 wt. %, at least 70 wt. %, at least 80 wt. %, at least 90 wt. %, or even at least 99 wt. % of the hydrogen sulfide in the first effluent 30 may be removed between the low-severity hydrotreater 20 and the high-severity hydrotreater 40.

According to some embodiments, at least some ammonia may be removed from the first effluent 30 between the low-severity hydrotreater 20 and the high-severity hydrotreater 40. For example, at least 10 wt. %, at least 20 wt. %, at least 30 wt. %, at least 40 wt. %, at least 50 wt. %, at least 60 wt. %, at least 70 wt. %, at least 80 wt. %, at least 90 wt. %, or even at least 99 wt. % of the ammonia in the first effluent 30 may be removed between the low-severity hydrotreater 20 and the high-severity hydrotreater 40.

The hydrogen sulfide and/or ammonia may be removed through any conventional methods, such as gas-liquid separation. The gas-liquid separation may include both high-pressure high-temperature separators and high-pressure low-temperature separators, or only high-pressure low-temperature separators. Removal of hydrogen sulfide may entail the removal of hydrogen generally from the stream. Accordingly, fresh and/or recycled hydrogen may be added to the high-severity hydrotreater 40. Additional heat exchangers, air coolers, and water coolers may be present between the low-severity hydrotreater 20 and the high-severity hydrotreater 40, to enable the separation process to function efficiently.

In some embodiments, hydrogen sulfide may not be removed between the low-severity hydrotreater 20 and the high-severity hydrotreater 40. Leaving the hydrogen sulfide in the first effluent 30 may reduce capital expenditures.

Feeding the first effluent 30 from the low-severity hydrotreater 20 to the high-severity hydrotreater 40 may further comprise pumping or compressing the first effluent 30. The first effluent 30 may be at a higher pressure as it enters the high-severity hydrotreater 40 than it was when it left the low-severity hydrotreater 20. For example, the first effluent 30 may enter the high-severity hydrotreater 40 at a pressure 5, 10, 15, 20, 25, or 30 bar higher than the pressure of the first effluent 30 as it left the low-severity hydrotreater 20.

The high-severity hydrotreater 40 may operate at a LHSV of from 0.5 to 2, from 0.5 to 1.5, from 0.5 to 1.25, from 0.5 to 1, from 0.75 to 2, from 0.75 to 1.5, from 0.75 to 1.25, from 0.75 to 1, from 0.9 to 2, from 0.9 to 1.25, from 0.9 to 1, from 0.9 to 0.95, or any subset thereof.

The high-severity hydrotreater 40 may operate at a hydrogen partial pressure of greater than 40 bar. For example, the high-severity hydrotreater 40 may operate at a hydrogen partial pressure of greater than 45 bar, from 40 to 100 bar, from 40 to 80 bar, from 40 to 65 bar, from 40 to 65 bar, from 45 to 55 bar, or any subset thereof.

The high-severity hydrotreater 40 may operate at a WABT of from 350 to 450° C. For example, the high-severity hydrotreater 40 may operate at a WABT of from 350 to 400° C., from 350 to 375° C., from 360 to 370° C., or any subset thereof.

Hydrotreating the first effluent 30 may comprise exposing the first effluent 30 to a high-severity hydrotreating catalyst in the presence of hydrogen gas.

The high-severity hydrotreating catalyst may comprise supported metal catalysts. The metals may comprise transition metals, such as one or more of Ni, Mo, Co, and W. The support material may comprise silica, alumina, or silica-alumina. The silica, alumina, or silica-alumina of the support material may be amorphous, crystalline, or a combination thereof. For example, the high-severity hydrotreating catalyst may comprise at least 50 wt. %, at least 75 wt. %, at least 85 wt. %, at least 90 wt. %, at least 95 wt. %, or at least 99 wt. % or Ni, Mo, Co, W, and support material. In some exemplary embodiments, the high-severity hydrotreating catalyst may comprise Co, Mo, and Ni, supported on alumina. For example, the high-severity hydrotreating catalyst may comprise from 3 wt. % to 6 wt. % of Ni and from 15 wt. % to 20 wt. % of Mo, on a total weight of the active metals and support materials basis.

The high-severity hydrotreating catalyst may comprise less than 5 wt. % of precious metals. For example, the high-severity hydrotreating catalyst may comprise less than 1 wt. %, less than 0.5 wt. %, less than 0.1 wt. %, or even less than 0.01 wt. % of precious metals.

In some embodiments, the high-severity hydrotreating catalyst and the low-severity hydrotreating catalyst may comprise the same materials. For example, the high-severity hydrotreating catalyst may comprise at least 50 wt. %, at least 60 wt. %, at least 70 wt. %, at least 80 wt. %, at least 90 wt. %, or even at least 99 wt. % of the same metals as the low-severity hydrotreating catalyst.

The low contaminant product 50 of the high-severity hydrotreater 40 may comprise at least 50 wt. %, at least 75 wt. %, at least 90 wt. %, at least 99 wt. %, at least 99.9 wt. %, at least 99.99 wt. %, or even at least 99.999 wt. % of hydrocarbons. The hydrocarbons may be derived from the hydrocarbon feedstock 10.

The low contaminant product 50 may have a sulfur content of less than 500 ppm. For example, the low contaminant product 50 may have a sulfur content of less than 250 ppm, less than 125 ppm, less than 75 ppm, less than 50 ppm, less than 25 ppm, less than 10 ppm, less than 5 ppm, or even less than 1 ppm.

The low contaminant product 50 may have a sulfur content of less than 1% of the sulfur content of the hydrocarbon feedstock 10. For example, the low contaminant product 50 may have a sulfur content of less than 0.5%, less than 0.1%, less than 0.05%, or even less than 0.01% of the sulfur content of the hydrocarbon feedstock 10, when the sulfur content is measured on a mass basis.

It should be understood that the sulfur within the streams may be elemental sulfur, sulfur contained within a mineral, or contained within compounds such as aliphatic and aromatic compounds. However, sulfur in the form of dissolved hydrogen sulfide gas does not count when measuring the sulfur content of the streams.

EXAMPLES

The various aspects of the present disclosure will be further clarified by the following examples. The examples are illustrative in nature and should not be understood to limit the subject matter of the present disclosure.

Example 1: Comparative 100 liters of gas oil was treated in a single hydrotreater until the sulfur content was reduced to 10 ppmw. The gas oil stream was derived from an Arabian crude oil boiling nominally in the range of from 180° C.-370° C. Detailed properties of the gas oil stream are given in Table 1, the simulated distillation shown in Table 1 was performed according to ASTM D86. The feed was hydrodesulfurized, over a Co—Ni—Mo/Al catalyst, in a single hydrotreater until a sulfur content of 10 ppmw was achieved. The hydrotreater was operated at the conditions shown in Table 2.

TABLE 1

| Hydrocarbon Feed Properties | | |
|---|---|---|
| Property/Composition | Unit | Value |
| Specific Gravity @ 15° C. | | 0.8542 |
| Sulfur | wt. % | 1.43 |

TABLE 1-continued

| Hydrocarbon Feed Properties | | |
|---|---|---|
| Property/Composition | Unit | Value |
| Nitrogen | ppm | 50 |
| 0 | ° C. | 185 |
| 5 | ° C. | 224 |
| 10 | ° C. | 229 |
| 30 | ° C. | 282 |
| 50 | ° C. | 306 |
| 70 | ° C. | 340 |
| 90 | ° C. | 375 |
| 95 | ° C. | 389 |
| 100 | ° C. | 401 |

Example 2: Inventive 100 liters of the gas oil of Example 1 was processed in a two-step hydrotreating process of the present disclosure until 10 ppmw sulfur was achieved. The two hydrotreaters were operated at the conditions shown in Table 2.

TABLE 2

| Reaction Conditions | | | |
|---|---|---|---|
| Conditions | Comparative Example 1 | Inventive Example 2 | Inventive Example 2 |
| Reactor | Single Reactor | Low-severity hydrotreater | High-severity hydrotreater |
| Hydrogen partial pressure, bar | 50 | 15 | 50 |
| WABT, ° C. | 361 | 344 | 361 |
| LHSV, h-1 | 0.5853 | 10 | 0.9254 |
| Catalyst Volume, Lt | 171 | 10 | 108.53 |
| Hydrodesulfurization, wt. % | 99.9 | 56 | 99.9 |
| Hydrogen consumption, StLt/Kg | 75.15 | 32.14 | 59.95 |

Both the single step hydrotreater of Example 1 and the high-severity hydrotreater of Example 2 were operated at 50 bar of hydrogen partial pressure and 361° C. WABT. The single step reactor was operated to achieve 99.9 wt. % hydrodesulfurization. The low severity reactor of Example 2 was operated to achieve 56 wt. % of hydrodesulfurization and 99.9 wt. % hydrodesulfurization was achieved in the high severity reactor. The low severity hydrotreater required 15 bar of hydrogen partial pressure and 344° C. WABT to achieve the 56 wt. %. of hydrodesulfurization. Since the molecules in low boiling point ranges are reactive, low hydrogen partial pressure and temperatures are sufficient to achieve this conversion level. However, high severity is needed to achieve the 99.9 wt. % conversion level.

When 100 liters of SR gas oil is treated in the single step process of Example 1, it required 171 liters of catalyst. When the same feedstock was subjected to the two-step hydrotreating process of Example 2, the catalyst requirements were 10 and 108 liters, for low and high severity reactor, respectively. The total catalyst volume required was 118 liters, which is 30% less than the single reactor case.

Aspects

According to a first aspect of the present invention, a method of processing a hydrocarbon feedstock may comprise hydrotreating the hydrocarbon feedstock in a low-severity hydrotreater to produce a first effluent, and hydrotreating the first effluent, or a portion thereof, in a high-severity hydrotreater to produce a low contaminant product; wherein the low-severity hydrotreater operates at a catalyst volume of less than 60% of a catalyst volume of the high-severity hydrotreater; the low-severity hydrotreater operates at a hydrogen partial pressure of at least 5 bar lower than the hydrogen partial pressure in the high-severity hydrotreater; and the low-severity hydrotreater operates at a WABT of at least 5° C. less than the WABT of the high-severity hydrotreater.

According to a second aspect of the present invention, alone or in combination with the first aspect, the low-severity hydrotreater operates at a catalyst volume of less than 20% of a catalyst volume of the high-severity hydrotreater.

According to a third aspect of the present invention, alone or in combination with the first or second aspects, the high-severity hydrotreater operates at a LHSV of from 0.5 to 2.

According to a fourth aspect of the present invention, alone or in combination with any of the prior aspects, wherein the low-severity hydrotreater operates at a LHSV of from 5 to 15.

According to a fifth aspect of the present invention, alone or in combination with any of the prior aspects, wherein the low-severity hydrotreater operates at a hydrogen partial pressure of at least 25 bar lower than the high-severity hydrotreater.

According to a sixth aspect of the present invention, alone or in combination with any of the prior aspects, wherein the low-severity hydrotreater operates at a hydrogen partial pressure of less than 40% of the hydrogen partial pressure of the high-severity hydrotreater.

According to a seventh aspect of the present invention, alone or in combination with any of the prior aspects, wherein the low-severity hydrotreater operates at a hydrogen partial pressure from 5 to 30 bar.

According to an eighth aspect of the present invention, alone or in combination with any of the prior aspects, wherein the high-severity hydrotreater operates at a hydrogen partial pressure of from 40 to 65 bar.

According to a ninth aspect of the present invention, alone or in combination with any of the prior aspects, wherein the low-severity hydrotreater operates at a WABT of at least 15° C. less than the WABT of the high-severity hydrotreater.

According to a tenth aspect of the present invention, alone or in combination with any of the prior aspects, wherein the low-severity hydrotreater operates at a WABT of from 300 to 350° C.

According to an eleventh aspect of the present invention, alone or in combination with any of the prior aspects, wherein the high-severity hydrotreater operates at a WABT of from 350 to 450° C.

According to a twelfth aspect of the present invention, alone or in combination with any of the prior aspects, wherein the hydrocarbon feedstock has greater than 1000 ppm of sulfur.

According to a thirteenth aspect of the present invention, alone or in combination with any of the prior aspects, wherein the first effluent has less than 70% of the sulfur content of the hydrocarbon fraction.

According to a fourteenth aspect of the present invention, alone or in combination with any of the prior aspects, wherein the low contaminant product has less than 10 ppm of sulfur.

According to a fifteenth aspect of the present invention, alone or in combination with any of the prior aspects, wherein hydrotreating the hydrocarbon feedstock comprises exposing the hydrocarbon feedstock to a low-severity hydrotreating catalyst in the presence of hydrogen gas; hydrotreating the first effluent comprises exposing the first effluent to a high-severity hydrotreating catalyst in the presence of hydrogen gas; and the low-severity hydrotreating catalyst and the high-severity hydrotreating catalyst each comprise less than 1 wt. % of precious metals.

According to a sixteenth aspect of the present invention, alone or in combination with any of the prior aspects, wherein hydrotreating the hydrocarbon feedstock comprises exposing the hydrocarbon feedstock to a low-severity hydrotreating catalyst in the presence of hydrogen gas; hydrotreating the first effluent comprises exposing the first effluent to a high-severity hydrotreating catalyst in the presence of hydrogen gas; and the low-severity hydrotreating catalyst and the high-severity hydrotreating catalyst each comprise a supported transition metal.

According to a seventeenth aspect of the present invention, alone or in combination with any of the prior aspects, wherein hydrogen sulfide and/or ammonia gasses are removed from the first effluent between the low-severity hydrotreater and the high-severity hydrotreater.

According to an eighteenth aspect of the present invention, alone or in combination with any of the prior aspects, wherein at least 90 wt. % of the first effluent from the low-severity hydrotreater is fed to the high-severity hydrotreater and at least 90 wt. % of the feed to the high-severity hydrotreater comprises the first effluent.

According to a nineteenth aspect of the present invention, alone or in combination with any of the prior aspects, wherein the hydrocarbon feedstock comprises greater than 500 ppm of sulfur.

According to a twentieth aspect of the present invention, alone or in combination with any of the prior aspects, wherein the hydrocarbon feedstock comprises a whole crude or a fraction of a whole crude.

It is noted that any two quantitative values assigned to a property may constitute a range of that property, and all combinations of ranges formed from all stated quantitative values of a given property are contemplated in this disclosure.

It is noted that one or more of the following claims utilize the term "where" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

Having described the subject matter of the present disclosure in detail and by reference to specific aspects, it is noted that the various details of such aspects should not be taken to imply that these details are essential components of the aspects. Rather, the claims appended hereto should be taken as the sole representation of the breadth of the present disclosure and the corresponding scope of the various aspects described in this disclosure. Further, it will be apparent that modifications and variations are possible without departing from the scope of the appended claims.

What is claimed is:

1. A method of processing a hydrocarbon fraction, the method comprising:

hydrotreating the hydrocarbon feedstock in a low-severity hydrotreater to produce a first effluent, and hydrotreating the first effluent, or a portion thereof, in a high-severity hydrotreater to produce a low contaminant product; wherein the low-severity hydrotreater operates at a catalyst volume of less than 60% of a catalyst volume of the high-severity hydrotreater;

the low-severity hydrotreater operates at a hydrogen partial pressure of at least 5 bar lower than the hydrogen partial pressure in the high-severity hydrotreater; and the low-severity hydrotreater operates at a weighted average bed temperature ("WABT") of at least 5° C. less than the WABT of the high-severity hydrotreater.

2. The method of claim 1, wherein the low-severity hydrotreater operates at a catalyst volume of less than 20% of a catalyst volume of the high-severity hydrotreater.

3. The method of claim 1, wherein the high-severity hydrotreater operates at a LHSV of from 0.5 $h^{-1}$ to 2 $h^{-1}$.

4. The method of claim 1, wherein the low-severity hydrotreater operates at a LHSV of from 5 $h^{-1}$ to 15 $h^{-1}$.

5. The method of claim 1, wherein the low-severity hydrotreater operates at a hydrogen partial pressure of at least 25 bar lower than the high-severity hydrotreater.

6. The method of claim 1, wherein the low-severity hydrotreater operates at a hydrogen partial pressure of less than 40% of the hydrogen partial pressure of the high-severity hydrotreater.

7. The method of claim 1, wherein the low-severity hydrotreater operates at a hydrogen partial pressure from 5 to 30 bar.

8. The method of claim 1, wherein the high-severity hydrotreater operates at a hydrogen partial pressure of from 40 to 65 bar.

9. The method of claim 1, wherein the low-severity hydrotreater operates at a WABT of at least 15° C. less than the WABT of the high-severity hydrotreater.

10. The method of claim 1, wherein the low-severity hydrotreater operates at a WABT of from 300 to 350° C.

11. The method of claim 1, wherein the high-severity hydrotreater operates at a WABT of from 350 to 450° C.

12. The method of claim 1, wherein the hydrocarbon feedstock has greater than 1000 ppm of sulfur.

13. The method of claim 1, wherein the first effluent has less than 70% of the sulfur content of the hydrocarbon fraction.

14. The method of claim 1, wherein the low contaminant product has less than 10 ppm of sulfur.

15. The method of claim 1, wherein hydrotreating the hydrocarbon feedstock comprises exposing the hydrocarbon feedstock to a low-severity hydrotreating catalyst in the presence of hydrogen gas;

hydrotreating the first effluent comprises exposing the first effluent to a high-severity hydrotreating catalyst in the presence of hydrogen gas; and the low-severity hydrotreating catalyst and the high-severity hydrotreating catalyst each comprise less than 5 wt. % of precious metals.

16. The method of claim 1, wherein hydrotreating the hydrocarbon feedstock comprises exposing the hydrocarbon feedstock to a low-severity hydrotreating catalyst in the presence of hydrogen gas;

hydrotreating the first effluent comprises exposing the first effluent to a high-severity hydrotreating catalyst in the presence of hydrogen gas; and the low-severity hydrotreating catalyst and the high-severity hydrotreating catalyst each comprise a supported transition metal.

17. The method of claim 1, wherein hydrogen sulfide and/or ammonia gasses are removed from the first effluent between the low-severity hydrotreater and the high-severity hydrotreater.

18. The method of claim 1, wherein at least 90 wt. % of the first effluent from the low-severity hydrotreater is fed to the high-severity hydrotreater and at least 90 wt. % of the feed to the high-severity hydrotreater comprises the first effluent.

19. The method of claim 1, wherein the hydrocarbon feedstock comprises greater than 500 ppm of sulfur.

20. The method of claim 1, wherein the hydrocarbon feedstock comprises a whole crude or a fraction of a whole crude.

* * * * *